US005735066A

United States Patent [19]

Tochizawa et al.

[11] Patent Number: 5,735,066

[45] Date of Patent: Apr. 7, 1998

[54] WORKING MACHINE CONTROL DEVICE FOR CONSTRUCTION MACHINERY

[75] Inventors: Mamoru Tochizawa, Takaoka; Atsushi Nagira, Hiratsuka, both of Japan

[73] Assignee: Komatsu Ltd., Japan

[21] Appl. No.: 666,347

[22] PCT Filed: Dec. 27, 1994

[86] PCT No.: PCT/JP94/02254

§ 371 Date: Jun. 19, 1996

§ 102(e) Date: Jun. 19, 1996

[87] PCT Pub. No.: WO95/18272

PCT Pub. Date: Jul. 6, 1995

[30] Foreign Application Priority Data

Dec. 28, 1993 [JP] Japan ..... 5-337462

[51] Int. Cl.[6] ..... E02F 5/02; G06F 7/70

[52] U.S. Cl. ..... 37/348; 37/414; 414/699; 364/424.07

[58] Field of Search ..... 37/348, 382, 414, 37/907; 364/424.07; 414/699, 700, 701; 172/4

[56] References Cited

U.S. PATENT DOCUMENTS

| | | | |
|---|---|---|---|
| 3,900,113 | 8/1975 | Bourges | 414/699 X |
| 4,910,673 | 3/1990 | Narisawa et al. | 364/424.07 |
| 5,257,177 | 10/1993 | Bach et al. | 364/424.07 X |
| 5,363,304 | 11/1994 | Awano et al. | 364/424.07 |
| 5,446,981 | 9/1995 | Kamada et al. | 37/348 |
| 5,490,081 | 2/1996 | Kuromoto et al. | 37/414 X |
| 5,598,648 | 2/1997 | Moriya et al. | 37/348 |

FOREIGN PATENT DOCUMENTS

| | | | |
|---|---|---|---|
| 54-88604 | 7/1979 | Japan . | |
| 62-82127 | 4/1987 | Japan . | |
| 63-194030 | 8/1988 | Japan . | |
| 363277325 | 11/1988 | Japan | 364/424.07 |
| 1-27150 | 10/1989 | Japan . | |
| 402101229 | 4/1990 | Japan | 37/348 |
| 403166425 | 7/1991 | Japan | 37/348 |
| 404143330 | 5/1992 | Japan | 37/348 |
| 5-112971 | 5/1993 | Japan . | |

*Primary Examiner*—Terry Lee Melius
*Assistant Examiner*—Thomas A. Beach
*Attorney, Agent, or Firm*—Greer, Burns & Crain, Ltd.

[57] ABSTRACT

A construction machinery having a first boom 1 rotatably mounted on a vehicle frame, a second boom 4 rotatably mounted on the first boom 1, a first boom cylinder 2 connecting the vehicle frame 3 and the second boom 4, and a second boom cylinder 5 connecting the second boom 4 and the first boom 1, characterized in that it is arranged in such a way that the drive of the working machines in the new link mechanism is controlled simply and with high precision by indicating the position or the velocity of the working machine leading end by subjecting a working machine leading end target value to coordinate conversion to the target angles for the first and second boom angles, determining the target cylinder length for the first boom cylinder 2 from the target angles for the first and second boom angles obtained by the coordinate conversion, and driving the first boom cylinder 2 according to the target cylinder length.

4 Claims, 12 Drawing Sheets

WORKING MACHINE CONTROL DEVICE FOR CONSTRUCTION MACHINERY

TECHNICAL FIELD

This invention relates to a shovel machine having a plurality of arms, and more particularly to improving the operability of shovel machinery with a two-piece boom.

BACKGROUND ART

FIG. 7 shows a general conventional type of power shovel with a two-piece boom, wherein a first boom cylinder 2 which drives a first boom is connected to a vehicle frame 3 and the first boom 1, and a second boom cylinder 5 which drives a second boom 4 is connected to the first boom 1 and the second boom 4. That is to say, in this two-piece boom type of power shovel, each cylinder connects two adjacent working machines and, therefore, when one cylinder is driven, one working machine corresponding to that cylinder is driven in rotation.

Consequently, in this power shovel, as shown in FIG. 8, when second boom cylinder 5 is driven, second boom 4 moves, and only the angle θ2 formed by first boom 1 and second boom 4 changes.

Further, with this power shovel it has been normal to adopt the co-ordinate system shown in FIG. 9, end to carry out the position control shown in FIG. 10 or the velocity control shown in FIG. 11.

Thus, as shown in FIG. 9, track control has been considered in which the leading end of second boom 4 is adopted as a target position (xr, yr).

In the position control shown in FIG. 10, after the target position (xr, yr) has been determined, target angles θir (i=1,2 . . .) for each working machine corresponding to the target position are determined by coordinate conversion. Then, after obtaining angle sensor output θia (i=1,2 . . .) for each working machine, the difference ei between the two (=θir−θia) is determined for each shaft, and flow rate command values proportional to each ei are respectively applied to the cylinders of each shaft.

Further, in the velocity control shown in FIG. 11, after the target velocity ($xr^{\cdot}$, $yr^{\cdot}$) has been determined, the target velocity $\theta ir^{\cdot}$ of each shaft is determined by inverse Jacobjan matrix.

It should be noted that in this Specification the reference mark to indicate velocity is a dash (for example, $xr^{\cdot}$ and $yr^{\cdot}$). In the figures it is marked with a dot (•).

Then, by the addition of various compensations to the target velocities $\theta ir^{\cdot}$ for each abovementioned shaft, $\theta io^{\cdot}$ is determined, and a non-linear link ratio (link gain) $si^{\cdot}=f(\theta i)\theta ir^{\cdot}$ is determined. Also, flow rate command values proportional to each link gain $si^{\cdot}$ are respectively applied to the cylinders of each shaft.

That is to say, the abovementioned controls take advantage of the characteristic whereby the angle or angular velocity of each working machine corresponds one to one with the position or velocity of each cylinder, and are comparatively easy for the operator to handle.

In contrast to the general link structure in such a two-piece boom type of power shovel, the present Applicant proposed, in Japanese Patent Application Hei 4-283538, a completely new link structure which has advantages in that, for example, the working machines can be folded compactly during running and transportation, and that an ultra-small and low turning position is possible because boom angles can be adopted freely.

FIG. 12 shows a power shovel having this new link structure, where 1 is the first boom, 2 is the first boom cylinder, 3 is the vehicle frame, 4 is the second boom, 5 is the second boom cylinder, 6 is the arm, 7 is the arm cylinder, 8 is the bucket, and 9 is the bucket cylinder.

In other words, this link structure is arranged in such a way that the first boom cylinder 2 connects to vehicle frame 3 and second boom 4, and the second boom cylinder 5 connects to second boom 4 and first boom 1; and the second boom 4 is driven by first boom cylinder 2 and second boom cylinder 5.

However, using this link mechanism, for example as shown in FIG. 13, when the second boom cylinder 5 is driven, both the first boom angle θ1 and the second boom angle θ2 change. That is to say, two working machines are moved by one cylinder. Therefore, when performing the common operation in which the second boom cylinder 5 is extended in order make second boom 4 head downwards, it can happen that second boom 4 heads upwards as a result as shown in FIG. 13 (*b*).

Further, with this link mechanism, it is difficult to judge intuitively which cylinder should be extended and to what extent, even when attempting to bring the working machine leading end to the desired position. Moreover, with the abovementioned link, things become increasingly difficult when an operation is required which calls for complex work such as horizontal levelling.

Thus, the link in FIG. 12 moves in a different way to conventional links and is therefore difficult for the operator to handle. Consequently, when this link mechanism is operated, there are major problems with operability given the operating methods generally used conventionally, in which each working machine is operated separately.

Further, when controlling the abovementioned link using a two dimensional operating lever which respectively carries out working machine leading end position or velocity indication in the xy direction in FIG. 9, the fact that the working machine angles and cylinders have a one to one correspondence is used in the conventional procedures shown in FIGS. 10 and 11, and therefore the abovementioned conventional procedures cannot be employed as they are.

Therefore, an object of the present invention is to provide a working machine control device for construction machinery wherein the drive of the working machines in the abovementioned new link mechanism is controlled simply and with high precision by indicating the position or the velocity of the working machine leading end.

Here, the power shovel has a storing action for shifting the working machines from a working position to a travelling position as shown in FIG. 14, and an opening-out action where the working machines are shifted from the abovementioned travelling position to the working position.

However, in the past the storing action and the opening-out action have been conducted under manual operation by the operator.

Consequently, there have been problems in that, inter alia, when the abovementioned stored position was assumed, the working machines struck the vehicle body causing damage, and, when travelling, the working machines caused an annoying clatter by hitting against the vehicle frame when the stored position was not properly adopted.

Further, the stored position with a low center of gravity shown in FIG. 15 can be adopted by the abovementioned two-piece boom type of power shovel with the new link configuration shown in FIG. 12, but, with this power shovel, care must be taken that the arm 6 and the second boom top do not hit against the chassis (the mount where the bucket is placed) 30.

In order to avoid the abovementioned collisions, as shown in FIG. 16, the second boom top should be moved in a straight line to a predetermined position Q as indicated by the dotted line G in the figure, but this requires a complex operation which is impossible for the inexperienced operator. Further, if it is attempted to raise first boom 1 on its own during the opening-out action, then the second boom cylinder 5 accompanies it, descends and hits against a counterweight 31, and it has been necessary to have a complex operation of raising second boom 4 while also raising first boom 1, which is both difficult and time consuming. FIG. 17 shows the working position.

With the foregoing in view, it is an object of this invention to provide a working machine control device for construction machinery arranged in such a way that the actions of opening-out and storing the working machines are carried out automatically.

SUMMARY OF THE INVENTION

This invention concerns construction machinery having a first boom rotatably mounted on a vehicle frame, a second boom rotatably mounted on the first boom, a first boom cylinder connecting the vehicle frame and the second boom, and a second boom cylinder connecting the second boom and the first boom, which is arranged in such a way that a working machine leading end target value is subjected to coordinate conversion to the target angles for the first and second boom angles, the target cylinder length for the first boom cylinder is determined from the target angles for the first and second boom angles obtained by the coordinate conversion, and the first boom cylinder is driven according to the target cylinder length.

That is to say, in a link arrangement in which a first boom cylinder is connected to the vehicle frame and a second boom, and a second boom cylinder is connected to the first boom and the second boom, the first boom cylinder length is governed both by the first boom angle and the second boom angle. Consequently, exact working machine position control is carried out by converting a working machine leading end target value to target angles for the first and second boom angles, determining the target cylinder length for the first boom cylinder from the target values for the first and second boom angles obtained by the coordinate conversion, and driving the first boom cylinder according to the target cylinder length.

Further, according to the invention, the construction machinery having a first boom rotatably mounted on the vehicle frame, a second boom rotatably mounted on the first boom, a first boom cylinder connecting the vehicle frame and the second boom, and a second boom cylinder connecting the second boom and first boom, is arranged in such a way that a working machine leading end target velocity is converted to the target angular velocities of the first and second boom angles, and the target cylinder velocity of the first boom cylinder is determined from the target angular velocities for the first and second boom angles obtained by the conversion, and the first boom cylinder is driven according to the target cylinder velocity.

That is to say, according to the abovementioned link configuration, the first boom cylinder velocity is governed both by the first boom angular velocity and the second boom angular velocity. Consequently, exact working machine velocity control is carried out by converting a working machine leading end target velocity to the target angular velocities for the first and second boom angles, determining the target cylinder velocity for the first boom cylinder from the target angular velocities for the first and second boom angles obtained by the conversion, and driving the first boom cylinder according to the target cylinder velocity.

In this way, the present invention enables working machines, which have a link mechanism where the cylinder movement and the working machine angles do not have a one to one correspondence, to be driven exactly using a simple operation.

Furthermore, according to the invention, working machinery equipped with booms, arms and buckets is equipped with operating instruction means which gives operating instructions for the storage action and opening-out action of the working machines, and with opening-out and storage control means which automatically stores or opens-out the working machines following a predetermined track set in advance by instructions from the operating instruction means.

According to the invention, when the operating instruction is given for storage or opening out, the working machines are stored or opened out automatically along the predetermined track. Consequently, according to the invention, the actions of storing and opening-out the working machines are carried out automatically, and therefore the working machines no longer cause damage by striking the vehicle body, and working efficiency and safety can be improved.

BEST MODE FOR CARRYING OUT THE INVENTION

A detailed explanation of the invention is given below based on the embodiments shown in the appended figures.

Figure 3:
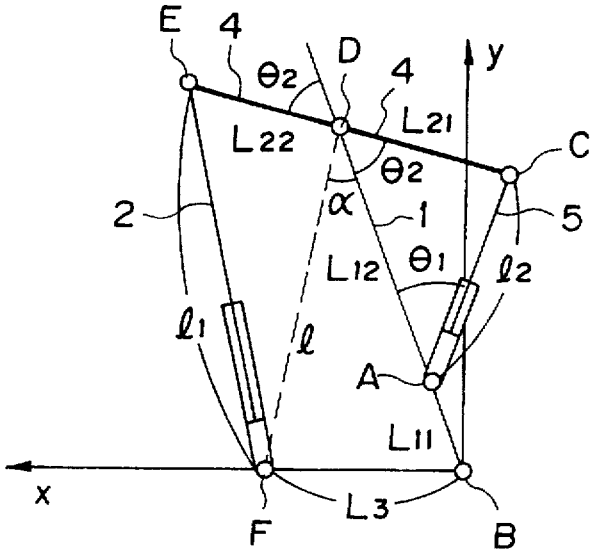
FIG. 3 is a figure showing the various working machine lengths; angles
Figure 12:
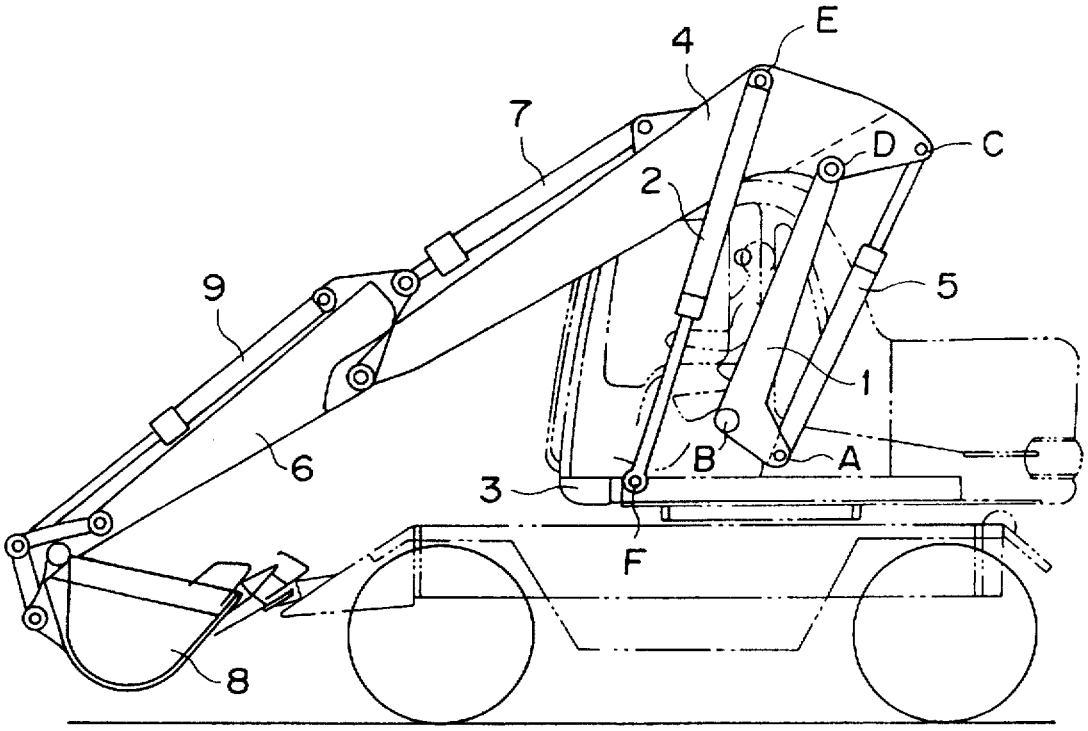
FIG. 12 is a figure showing the external configuration of a two-piece boom type of power shovel according to the invention.
Figure 13A:
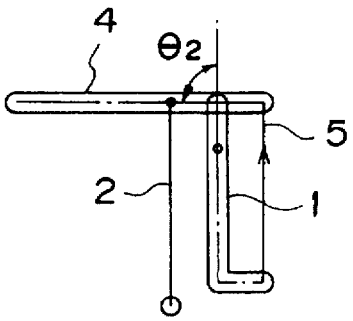
FIGS. 13(*a*) and 13(*b*) are figures illustrating the movement of the first and second booms of the two-piece boom type of power shovel according to the invention.
Figure 13B:
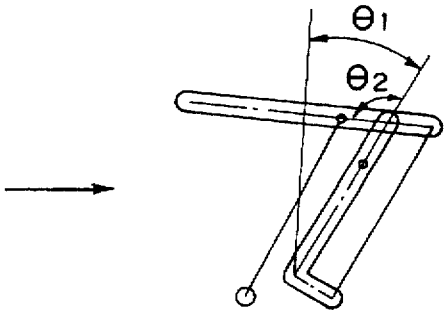
Figure 14:
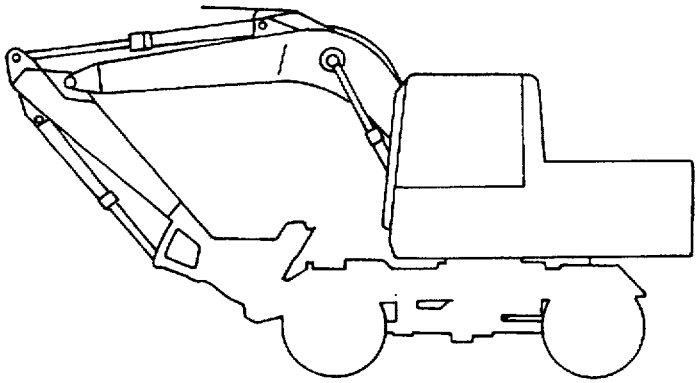
FIG. 14 is a figure showing the stored position for a normal power shovel.

Firstly, in relation to the parts of the first boom 1 and second boom 4 of the power shovel shown in FIG. 12, the simplified model shown in FIG. 3 is considered.

In FIG. 3, 1 is a first boom, 2 is a first boom cylinder, 4 is a second boom, 5 is a second boom cylinder; and identical references are ascribed corresponding to points A to F in FIG. 12.

In FIG. 3, 11 is the first boom cylinder length, 12 is a second boom cylinder length, θ1 is the first boom angle, θ2 is the second boom angle, and L11, L12, L21, L2 and L3 are all set values.

Now, assuming that L1=L11+L12 and L2=L21+L22, the three formulae (1), (2) and (3) are established according to the cosine theorem of triangles.

$$l_2^2=L_{12}^2+L_{21}^2 2L_{12}L_{21}\cos\theta_2 \quad (1)$$

$$l^2=L_1^2+L_3^2-2L_1L_3\cos\left(\frac{\pi}{2}-\theta_1\right) \quad (2)$$

$$a=\cos^{-1}\{(l^2+L_1^2-L_3^2)/2l\,L_1\} \quad (3)$$

Further, formula (4) below is established based on the formulae above and the cosine theorem for the triangle EDF.

$$\begin{aligned} l_1^2 &= l^2+L_{22}^2-2lL_{22}\cos(\pi-\alpha-\theta_2) \\ &= L_1^2+L_3^2+L_{22}^2-2L_1L_3\sin\theta_1+ \\ &\quad 2lL_{22}\cos(\alpha+\theta_2) \end{aligned} \quad (4)$$

Further, formula (5) below is established based on formula (4).

$$2l_1\dot{l}_1=-2L_1L_3\cos\theta_1\dot{\theta}_1+2\dot{l}L_{22}\cos(a+\theta_2)+2lL_{22}\sin(a+\theta_2)(\dot{a}+\dot{\theta}_2) \quad (5)$$

Further, formula (6) below is established from formula (2).

$$\dot{l}=-L_1L_3\cos\theta_1\dot{\theta}_1/l \quad (6)$$

Further, formula (7) below is established from formula (3).

$$\begin{aligned} \dot{\alpha} &= \frac{(L_1\cos\alpha-l)\dot{l}}{lL_1\sin\alpha} \\ &= \frac{(l-L_1\cos\alpha)L_1L_3\cos\theta_1\dot{\theta}_1}{l^2L_1\sin\alpha} \end{aligned} \quad (7)$$

Also, formula (8) below is formed by substituting these into formula (3).

$$\begin{aligned} \dot{l}_1 &= \left[\frac{-L_1L_3}{l_1}\cos\theta_1-\frac{L_1L_{22}L_3}{l_1l}\cos(\alpha+\theta_2)\cos\theta_1+\frac{L_1L_{22}L_3\sin(\alpha+\theta_2)(l-L_1\cos\alpha)\cos\theta_1}{l_1lL_1\sin\alpha}\right]\dot{\theta}_1-\frac{lL_{22}}{l_1}\sin(\alpha+\theta_2)\dot{\theta}_2 \\ &= A\dot{\theta}_1+B\dot{\theta}_2 \end{aligned} \quad (8)$$

Here, according to formula (4), the length 11 of the first boom cylinder 2 is a function of θ1 and θ2.

Further, according to formula (8), the velocity 11⁻ of first boom cylinder 2 is also a function of θ1 and θ2.

Figure 1:
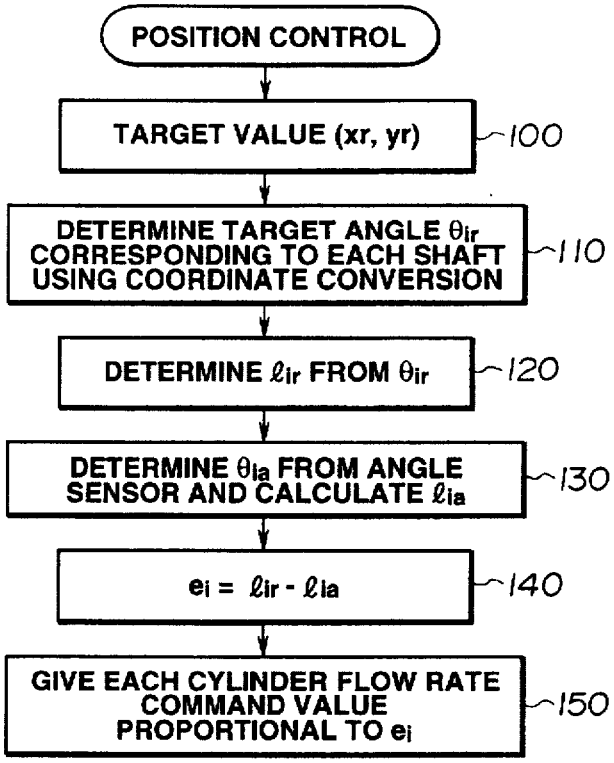
FIG. 1 is a flow chart showing an embodiment of the invention.

Consequently, when the first boom cylinder 2 is subjected to position control, then, as shown in FIG. 1, a working machine leading end target value (xr, yr) is first subjected to coordinate conversion (Steps 100 and 110) to the target angles (θ1r, θ2r) for the first and second boom angles, and then the target angles (θ1r, θ2r) for the first and second boom angles are substituted into formula (4), so that the target cylinder length 11*r* of the first boom cylinder 2 is determined (Step 120). Further, the current cylinder length 11*a* of the first boom cylinder 2 is determined by substituting the current values (θ1a, θ2a) of the first and second boom angles into formula (4) (Step 130). Then, e1 (=11*r*−11*a*) is computed, and a value proportional thereto is supplied to first boom cylinder 2 as a flow rate command value (Steps 140 and 150).

Figure 2:
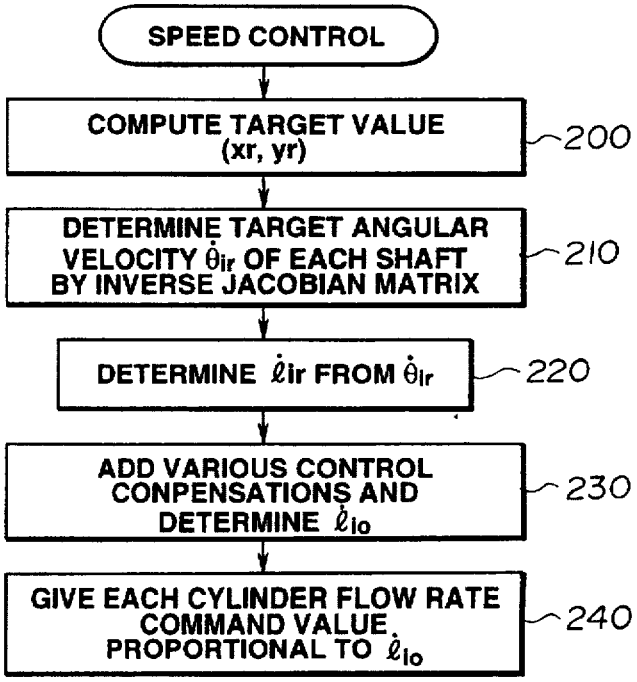
FIG. 2 is a flow chart showing an embodiment of the invention.

Further, when the first boom cylinder 2 is subjected to velocity control, then, as shown in FIG. 2, the target velocity (xr⁻, yr⁻) is computed (Step 200), and then the first and second boom angular velocities (θ1r⁻, θ2⁻) are determined by inverse Jacobian matrix (Step 210), and these angular velocities (θ1r⁻, θ2⁻) are substituted into formula (8), so that the target cylinder velocity 11*r*⁻ for first boom cylinder 1 is determined (Step 220). Furthermore, the target cylinder velocity 11*o* is determined with compensations of various types such as position feedback and pressure feedback added (Step 230), and a value proportional to the target cylinder velocity 110⁻ is supplied to first boom cylinder 2 as a flow rate command value (Step 240).

In this way, with the control of the present invention, it is possible to control a model where two working machines are operated by one cylinder by dropping the control, which in the past had been considered at the angle level, to the level of the cylinder which is actually being driven.

Incidentally, as regards the second boom cylinder 5, its length 12 is a function only of second boom angle θ2 as shown in the formula (1) above. That is to say, as regards the second boom cylinder 5, there is a one to one correspondence between the cylinder and its working machine angle. Consequently, in the control, a procedure of the present invention may be employed where the target angle θ2r is converted to the target cylinder length 12*r*, or a conventional procedure shown in the preceding FIGS. 11 and 12 may also be employed. The same holds true for the arm as well.

Figure 4:
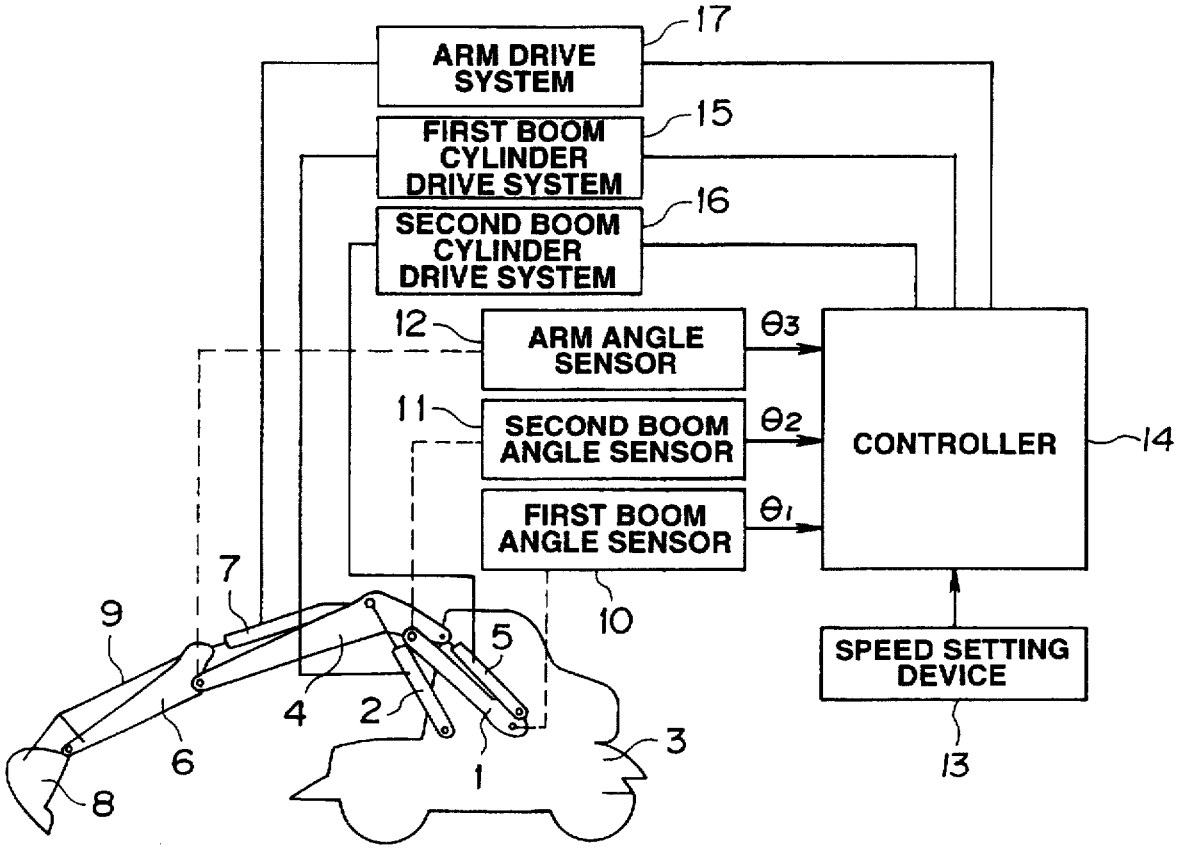
FIG. 4 is a block diagram showing an embodiment of the invention.

FIG. 4 shows a control configuration of the present invention wherein the abovementioned control is implemented, where first boom angle sensor 10, second boom angle sensor 11, and arm angle sensor 12 respectively detect first boom angle θ1, second boom angle θ2 and arm angle θ3.

The velocity setting apparatus 13 sets the velocity of movement of the working machine leading end (arm leading end, bucket leading end etc.) in the xy direction, and one can conceive of, for example, apparatuses in which the operating lever corresponds with the xy direction, apparatuses in which only the velocity is supplied by the operating lever and the direction supplied by separate angle-setting means, and apparatuses in which only the direction is indicated and the velocity pattern is held by a computation device.

A controller 14 carries out the computations discussed below according to the setting values of the velocity-setting apparatus 13 and the output of each of the sensors 10 to 12, thereby controlling the drive of the first boom cylinder drive system 15, second boom cylinder drive system 16 and arm drive system 17. The bucket control system has been omitted.

Figure 5:
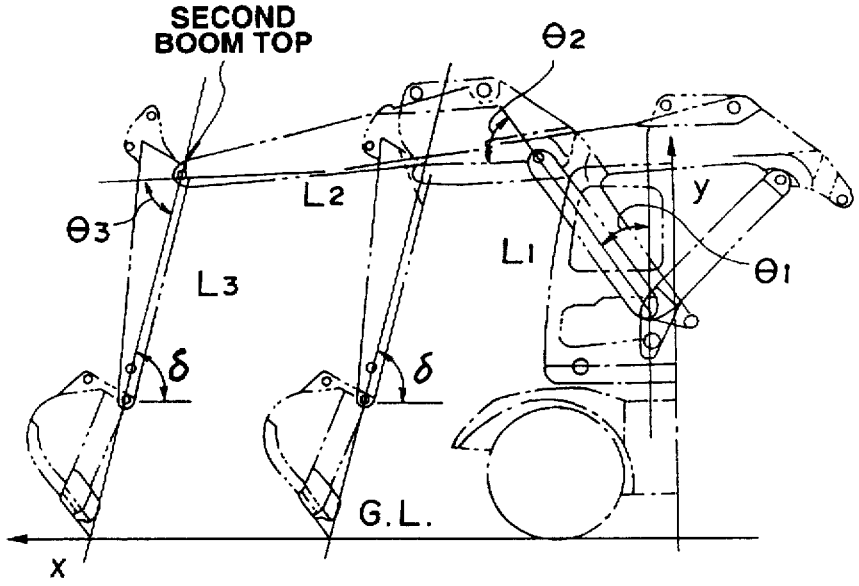
FIG. 5 is a figure showing the movement of the working machine during excavation in a straight line.

It has been assumed that in this configuration the horizontal excavation shown in FIG. 5 is being carried out. In other words, it is assumed that the arm leading end is horizontally controlled and the bucket is fixed at angle δ.

Formula (9) below is established when the arm leading end coordinates are (x123, y123), the xy coordinates of the leading end of the first boom 1 are (x1, y1), the xy coordinates of the leading end of the second boom 4 are (x2, y2) and the xy coordinates of the leading end of the arm 6 are (x3, y3). L1, L2 and L3 are respectively the first boom length, second boom length, and arm length.

$$\begin{aligned} x123 &= x1 + x2 + x3 \\ &= L1\sin\theta1 + L2\sin(\theta1+\theta2) + L3\sin(\theta1+\theta2+\theta3) \\ y123 &= y1 + y2 + y3 \\ &= L1\cos\theta1 + L2\cos(\theta1+\theta2) + L3\cos(\theta1+\theta2+\theta3) \\ \delta &= \theta1 + \theta2 + \theta3 - (\pi/2) \end{aligned} \tag{9}$$

Consequently, in order to conduct horizontal excavation with the bucket fixed, the system should be arranged such that δ=fixed, and y123 is kept to a predetermined value.

Firstly, the following formula (10) is obtained from the formula (9). Here, y23=y2+y3, −x23=−(x2+x3). The other entries are similar.

$$\begin{pmatrix} \dot{x}_{123} \\ \dot{y}_{123} \\ \dot{\delta}_{123} \end{pmatrix} = \begin{pmatrix} y_{123} & y_{23} & y_3 \\ -x_{123} & -x_{23} & -x_3 \\ 1 & 1 & 1 \end{pmatrix} \begin{pmatrix} \dot{\theta}_1 \\ \dot{\theta}_2 \\ \dot{\theta}_3 \end{pmatrix} \tag{10}$$

Further, the following formula (11) is obtained from the formula (10). Using formula (11), it is possible to obtain the target angular velocities θ1⁻, θ2⁻ θ3⁻ for the first boom angle, second boom angle and arm angle.

$$\begin{pmatrix} \dot{\theta}_1 \\ \dot{\theta}_2 \\ \dot{\theta}_3 \end{pmatrix} = \frac{1}{x_1y_2 - x_2y_1} \begin{pmatrix} -x_2 & -y_2 & -y_2x_3 + y_3x_2 \\ x_{12} & y_{12} & y_{12}x_3 - y_3x_{12} \\ -x_1 & -y_1 & -y_1x_{23} + y_{23}x_1 \end{pmatrix} \begin{pmatrix} \dot{x}_{123} \\ \dot{y}_{123} \\ \dot{\delta}_{123} \end{pmatrix} \tag{11}$$

Also, the target angular velocity 11⁻ for the first boom cylinder can be determined by substituting θ1⁻ and θ2⁻ determined by formula (11) into the formula (8).

It will be noted that the formula (8) above will take time to compute since it is extremely complicated. Because A and B in formula (8) above are functions of θ1 and θ2, the target angular velocity 11⁻ for the first boom cylinder can be determined in real time by compiling two-dimensional tables with θ1 and θ2 as factors for each of A and B.

Figure 6:
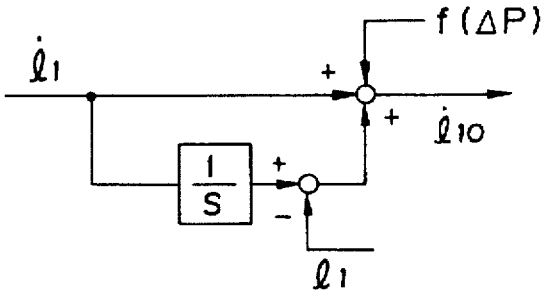
FIG. 6 is a figure showing the compensating element for velocity commands.
Figure 7:
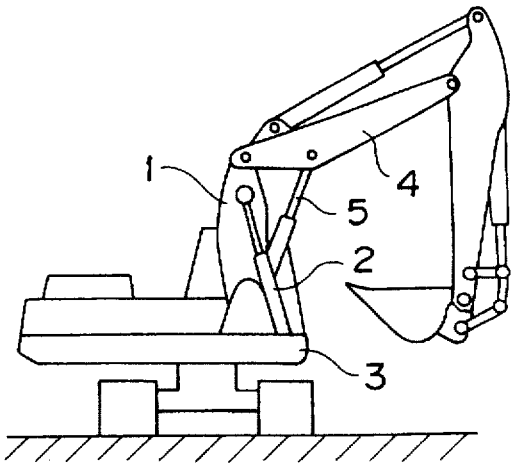
FIG. 7 is a figure showing a conventional two-piece boom type of power shovel.
Figure 8A:
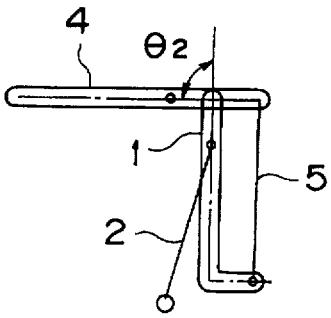
FIGS. 8(*a*) and 8(*b*) are figures illustrating the movement of the first and second booms of a conventional two-piece boom type of power shovel.
Figure 8B:
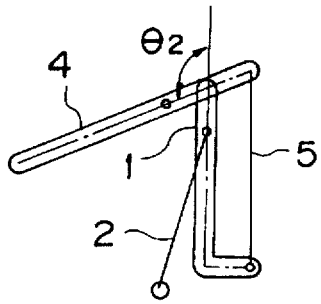
Figure 9:
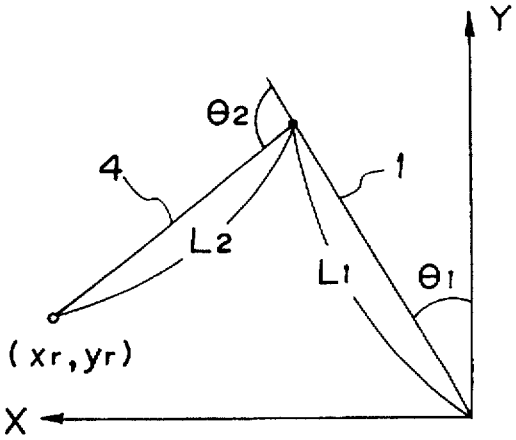
FIG. 9 is a figure showing the coordinate system for a conventional two-piece boom type of power shovel.
Figure 10:
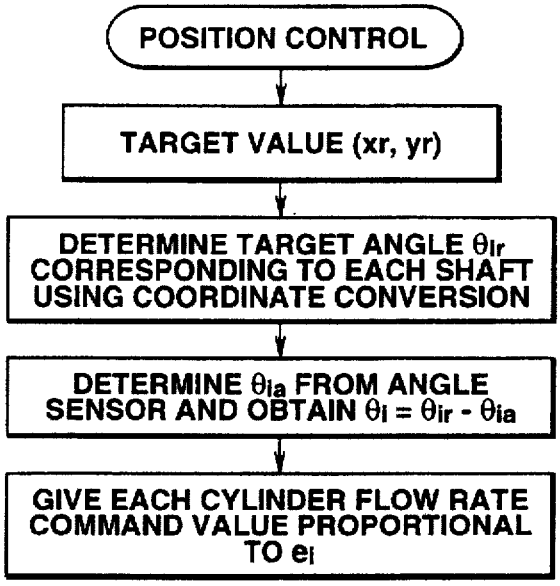
FIG. 10 is a flow chart showing working machine control in a conventional two-piece boom type of power shovel.

Thereafter, as shown in FIG. 6, compensation may be carried out with position feedback, hydraulic feedback and the like in the target angular velocity 11⁻ for the first boom cylinder, and a conversion may be made to a command **11*o*** with improved control properties.

In controller 14 in FIG. 5, computation is carried out as above, and the command **11*o* is input to first boom cylinder drive system 15, thereby controlling the drive of first boom cylinder 2**.

Figure 11:
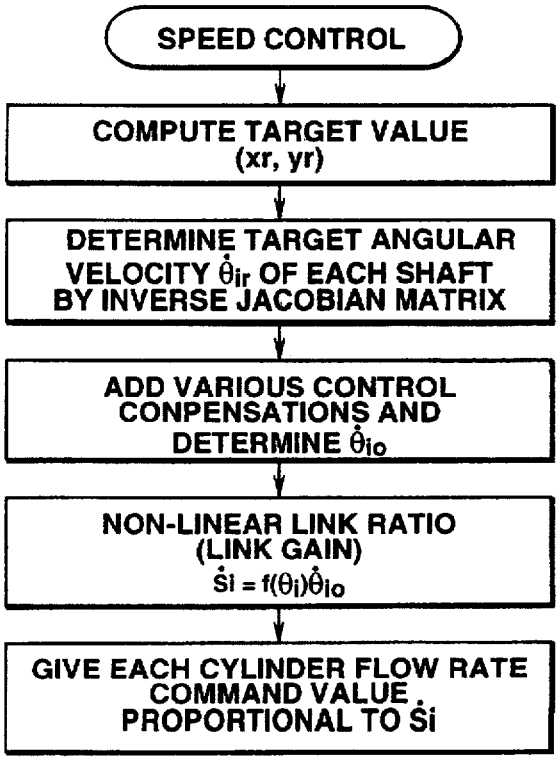
FIG. 11 is a flow chart showing working machine control in a conventional two-piece boom type of power shovel.

As regards the second boom cylinder and arm cylinder, as mentioned above there is a one to one correspondence between the cylinder and the working machine angle, and therefore either the procedure of the present invention where the target angle θir is converted to the target cylinder length lir, or the conventional procedure shown in the preceding FIG. 11, may be adopted.

As in the above, in controller 14 the command velocity lio of each cylinder is determined, and this is multiplied by the proportional gain corresponding to the valve characteristics of each working machine drive system, thereby determining the flow rate command value for each cylinder and controlling each working machine cylinder according to the flow command value.

Next an explanation will be given of an embodiment of the storing and opening-out action of the working machine.

Figure 15:
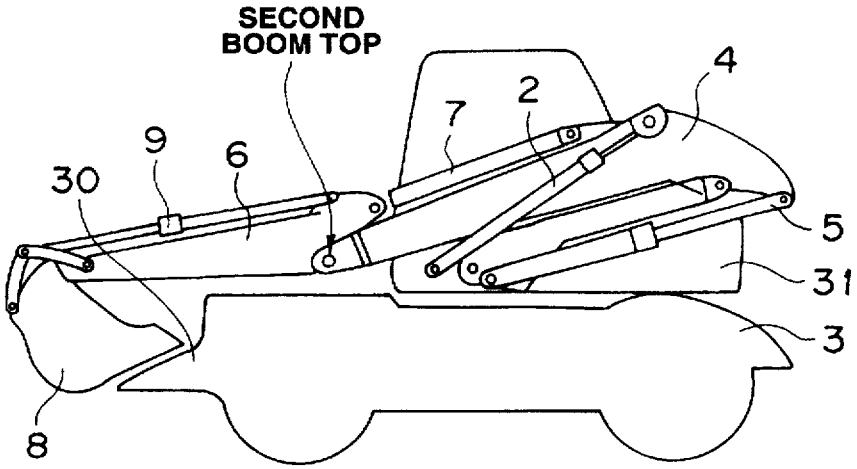
FIG. 15 is a figure showing the stored position of a two-piece boom type of power shovel according to the invention.
Figure 16:
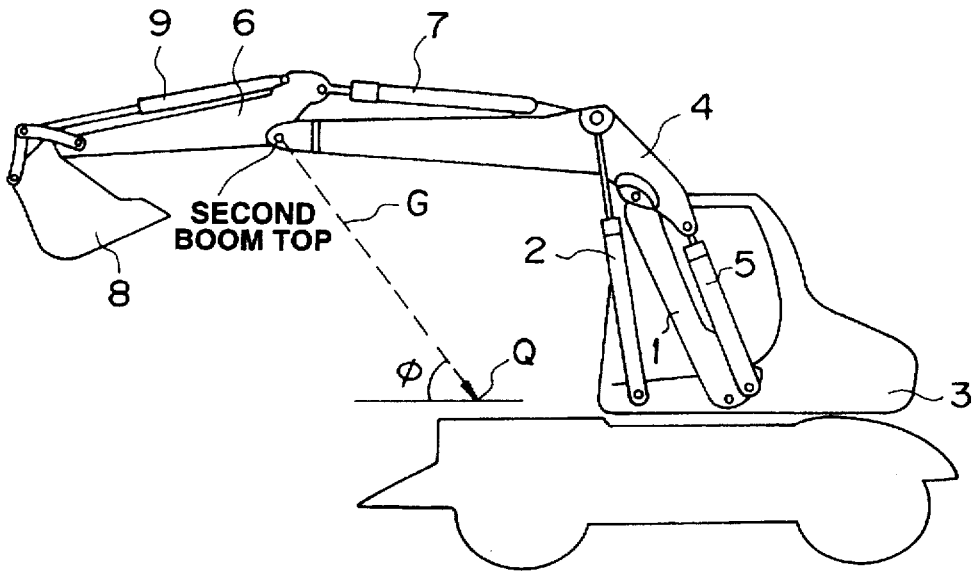
FIG. 16 is a figure showing an intermediate position when a two-piece boom type of power shovel according to the invention is performing a storage or opening-out action.
Figure 17:
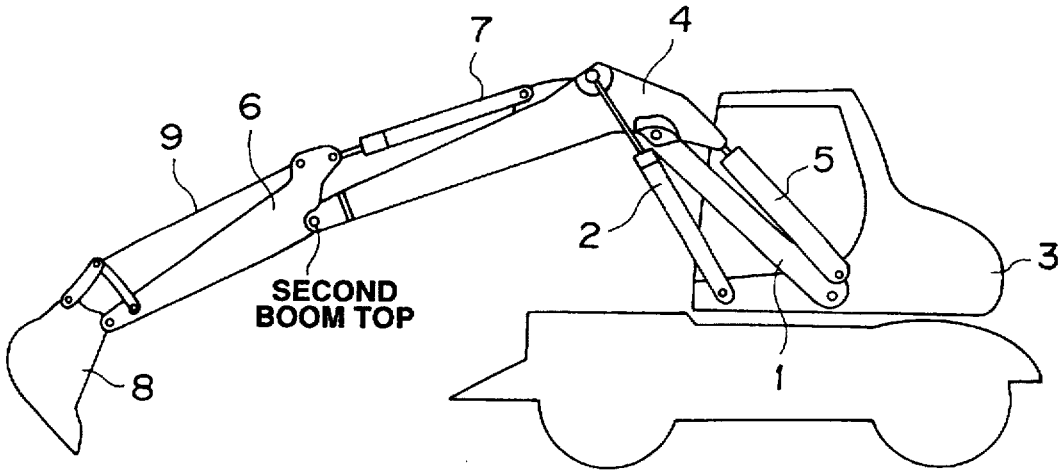
FIG. 17 is a figure showing a working position of a two-piece boom type of power shovel according to the invention.

The storing action is a series of actions shifting from the position in FIG. 17, via the position in FIG. 16 to the stored position in FIG. 15. The opening-out action is the reverse of this. That is to say, the storing action is where bucket 8 is driven to the tilt end from the position in FIG. 17, arm 6 is driven to the end of the stroke on the lift side, and the first boom 1 is raised, thereby shifting to the position in FIG. 16, and the second boom top is then moved in a straight line along broken line G to point Q thereby shifting to the stored position in FIG. 15.

In the embodiment below an explanation is given of a case where this series of actions is carried out automatically.

Figure 18:
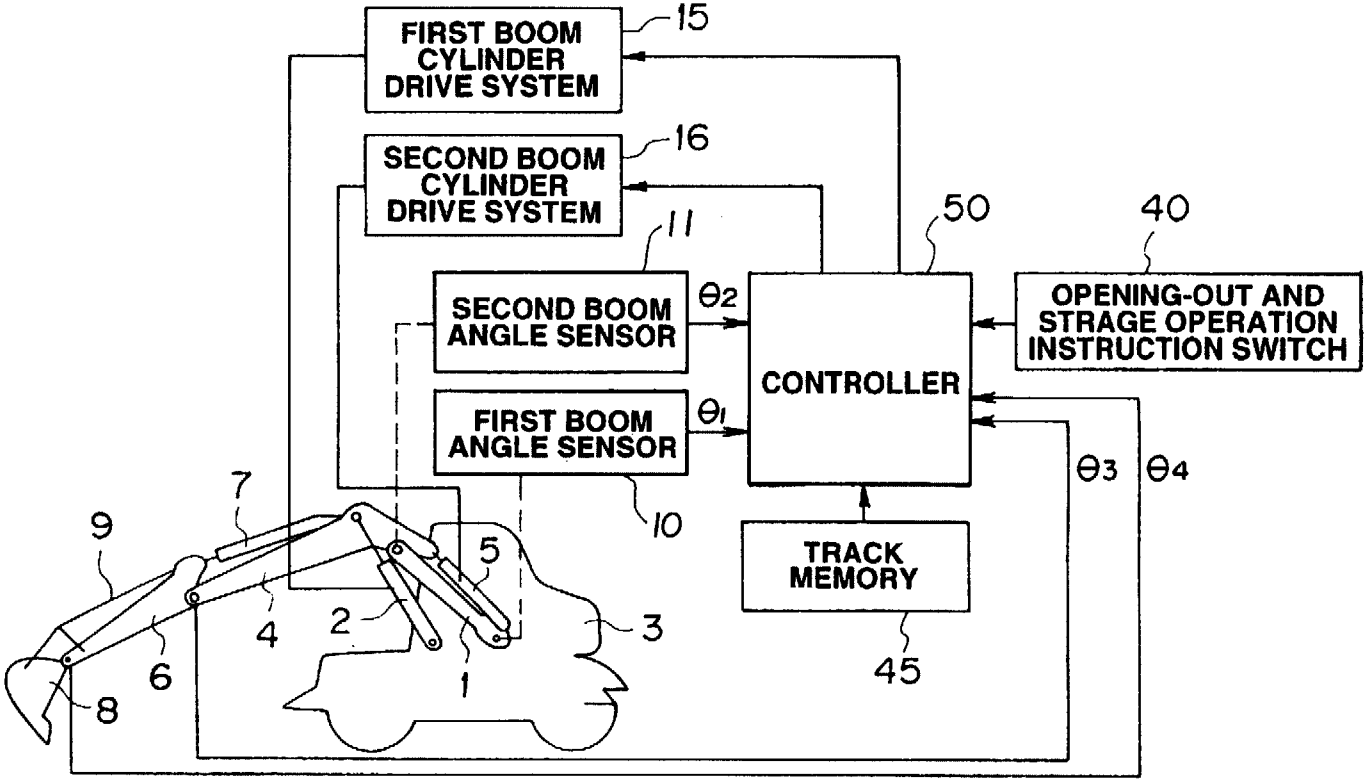
FIG. 18 is a figure showing a control configuration relating to the opening-out and storage action of the invention.

FIG. 18 shows a control configuration for this, in which first boom angle sensor 10 and second boom angle sensor 11 respectively detect first boom angle θ1 and second boom angle θ2. Further, arm angle θ3 and bucket angle θ4 are also detected and input to controller 50.

By way of example, the opening-out and storing operation instruction switch 40 is a knob switch on the working machine lever, and outputs an 'on' signal while the switch is depressed. Further, the velocity in the automatic storing operation may be changed in accordance with the displacement of a lever when such a lever is employed as the switch 40. That is to say, the velocity pattern is preset when the former is involved, whereas when the latter is involved it is possible for the operator to set the velocity.

Track memory 45 stores, for example, the tracks of each working machine in relation to the series of movements relating to the storing action and the opening-out action.

Figure 19:
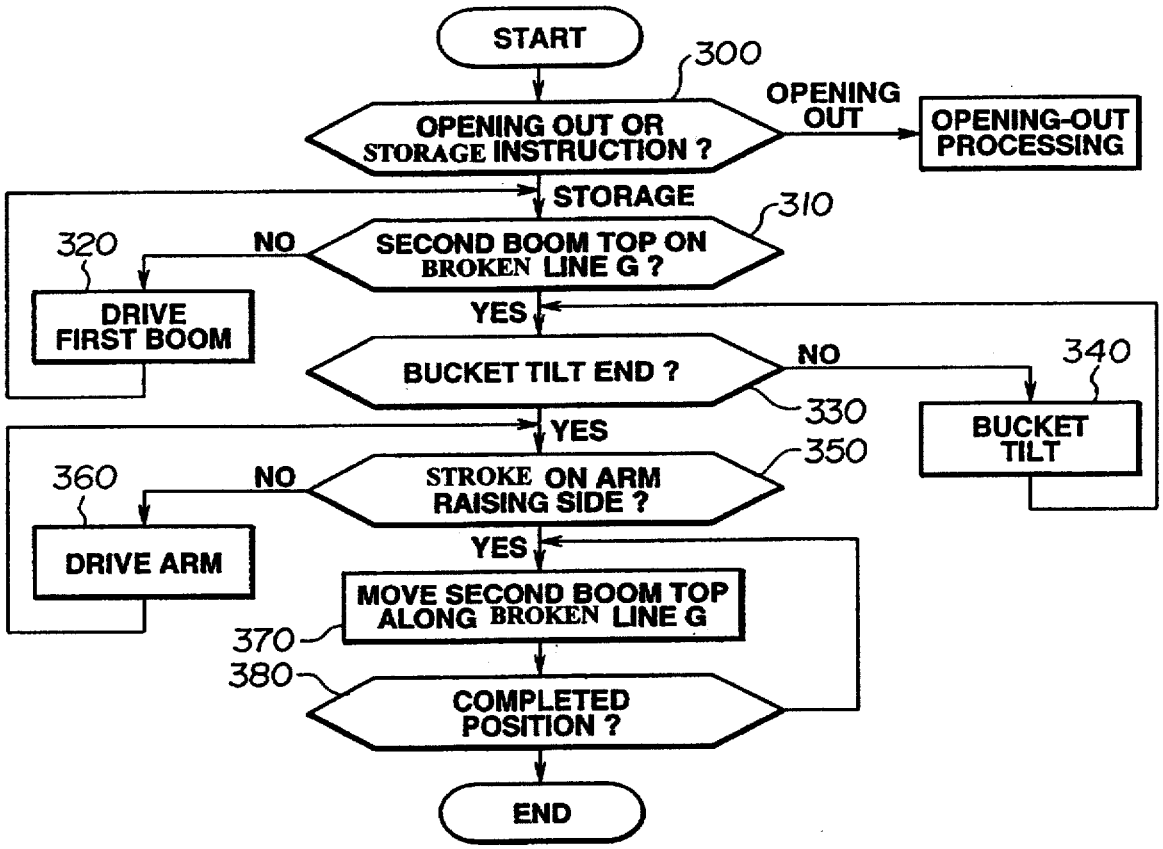
FIG. 19 is a flow chart showing the opening-out and storage action of the two-piece boom type of power shovel according to the present invention.

An explanation is given below of the automatic storing action using controller 50, with reference to the flow chart in FIG. 19.

Now, the position after completion of work is taken to be as shown in FIG. 17. Here, it is assumed that the operator has supplied a storage instruction using an opening-out operation instruction switch 40.

When controller 50 receives the storage instruction (Step 300), it judges whether or not the second boom top is positioned in a position nearly on broken line G shown in FIG. 16 (Step 310).

A method for this judgement is for example the method mentioned below.

Figure 20:
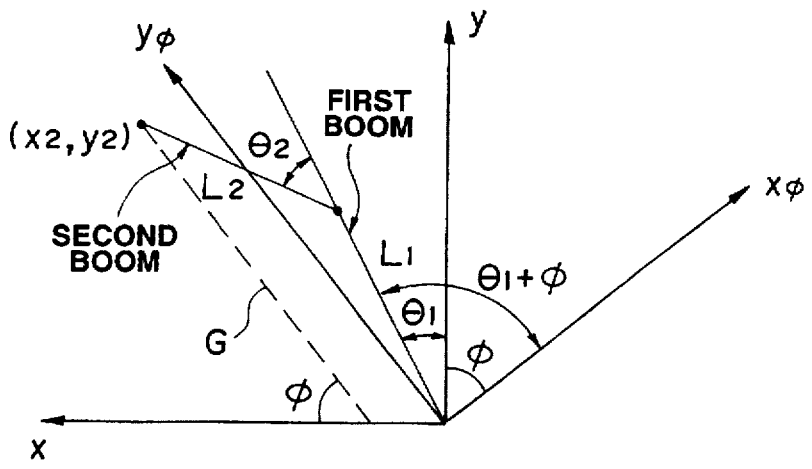
FIG. 20 is a figure showing coordinate conversion.

That is to say, as shown in FIG. 20, in the coordinate system xϕ–yϕ where the xy coordinate system has been rotated by the angle $\phi$ of the broken line G, first boom angle $\theta 1$ becomes $\theta 1+\phi$, and therefore in the new coordinate system $x\phi-y\phi$, the second boom coordinates (x2, y2) are as below.

$$x2=L1 \sin(\theta 1+\phi)+L2 \sin(\theta 1+\phi+\theta 2)$$

$$y2=L1 \cos(\theta 1+\phi)+L2 \cos(\theta 1+\phi+\theta 2) \quad (12)$$

Consequently, the coordinates for the boom top are determined by substituting the outputs $\theta 1$ and $\theta 2$ of first and second boom angle sensors 10 and 11 into formula (12) above. Further, the track of the broken line G is preset and stored in the track memory 45 as y=K (set value) in the new coordinate system. Consequently, by comparing the y coordinate of the boom top determined by the formula above with the set value K, it can be judged whether the boom top is above broken line G or below. Further, by carrying out the process of comparison keeping a margin in the set value K, it can be judged whether or not it is within a predetermined range near to the broken line G.

When the second boom top is not positioned in a position near to the broken line G according to this judgement, controller 50 drives first boom 1 so that the second boom top is positioned in a position near to the broken line G (Step 320). When the working machines are in the position in FIG. 17, first boom 1 is raised and the second boom top is positioned in a position near to the broken line G.

Next, controller 50 judges whether or not bucket 8 is positioned at the tilt end, and, if it is not, bucket cylinder 9 is driven to the end of the stroke on the extension side, and bucket 8 is positioned at the tilt end (Steps 330, 340).

Then, controller 50 judges whether or not arm 6 is positioned at the end of the stroke on the lifting side, and, if it is not, arm cylinder 7 is driven to the end of the stroke on the contraction side, so that arm 6 is positioned at the end of the stroke on the lifting side (Steps 350, 360).

Using the process above, the working machine is shifted to the state shown in FIG. 16.

Next, the second boom end is moved along broken line G, and the working machines are put into the stored position shown in FIG. 15 (Step 370).

In other words, first boom cylinder 2 and second boom cylinder 4 should be driven such that y2=K in formula (12) above. Possible methods for this include a method involving determining the target angles ($\theta 1r$, $\theta 2r$) for the first and second boom angles from target xy coordinates (x2, y2) obtained from the formula (12), and involving feedback control in such a way that these coincide with the current values ($\theta 1a$, $\theta 2a$) input from first and second boom angle sensors 10 and 11, and a method where the target velocity ($xr^{-}$, $yr^{-}$) is set (yr=0 in this case) and then the target angular velocities ($\theta 1r^{-}$, $\theta 2r^{-}$) of the first and second boom angles are determined, and control is carried out to this velocity.

Straight line movement control is carried out as above, and when the second boom top arrives at the predetermined completion position, movement of the first boom and second boom ceases. As a result, the working machines stop in the stored position shown in FIG. 15.

It will be noted that when the storage operation switch is turned off in the course of the above control, this is given priority in such a way that it rapidly halts in mid course even if it has not assumed the set stored position.

The opening-out control is carried out in reverse order to that above, and the final position may be either that in FIG. 16 or FIG. 17.

Incidentally, the shifting of the bucket from the position where it is touching the ground in FIG. 17 to the position in FIG. 16 is a comparatively straightforward operation, and therefore the operation may be conducted by the operator up until the second boom top reaches the position near to the broken line, and the shifting thereafter from FIG. 16 to FIG. 17 may be controlled automatically. In this case, a function may be added whereby a warning buzzer informs the operator whether the second boom top has reached a position near to the broken line, or else an additional function may be added where, for example, manual operation is made ineffective when the boom top is on the broken line and subsequent straight-line movement control is carried out automatically.

Next, an explanation is given with regard to storing control in a normal one-piece boom type of power shovel.

Figure 21:
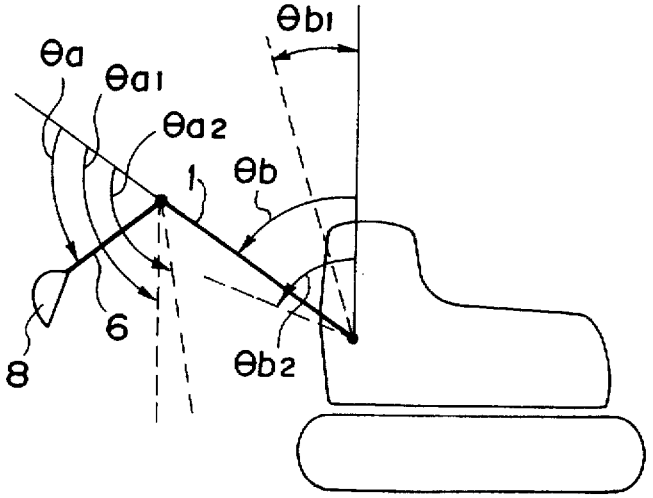
FIG. 21 is a figure showing set angles relating to the storage and opening-out action of a normal power shovel.

In FIG. 21, 1 is a boom, 6 is an arm, 8 is a bucket, $\theta b$ is a boom angle, and $\theta a$ is an arm angle. Further, $\theta b1$ is a boom angle where the bucket does not interfere with the chassis even when arm 6 is moving; $\theta b2$ is a boom angle where the bucket makes contact with the chassis when the arm is positioned at the end of the stroke on the tilt side; $\theta a1$ is an arm angle where the bucket does not interfere with the chassis even when the boom is moving; $\theta a2$ is an arm angle corresponding to where the arm is at the end of the stroke on the tilt side, and these are all predetermined set values.

Figure 22:
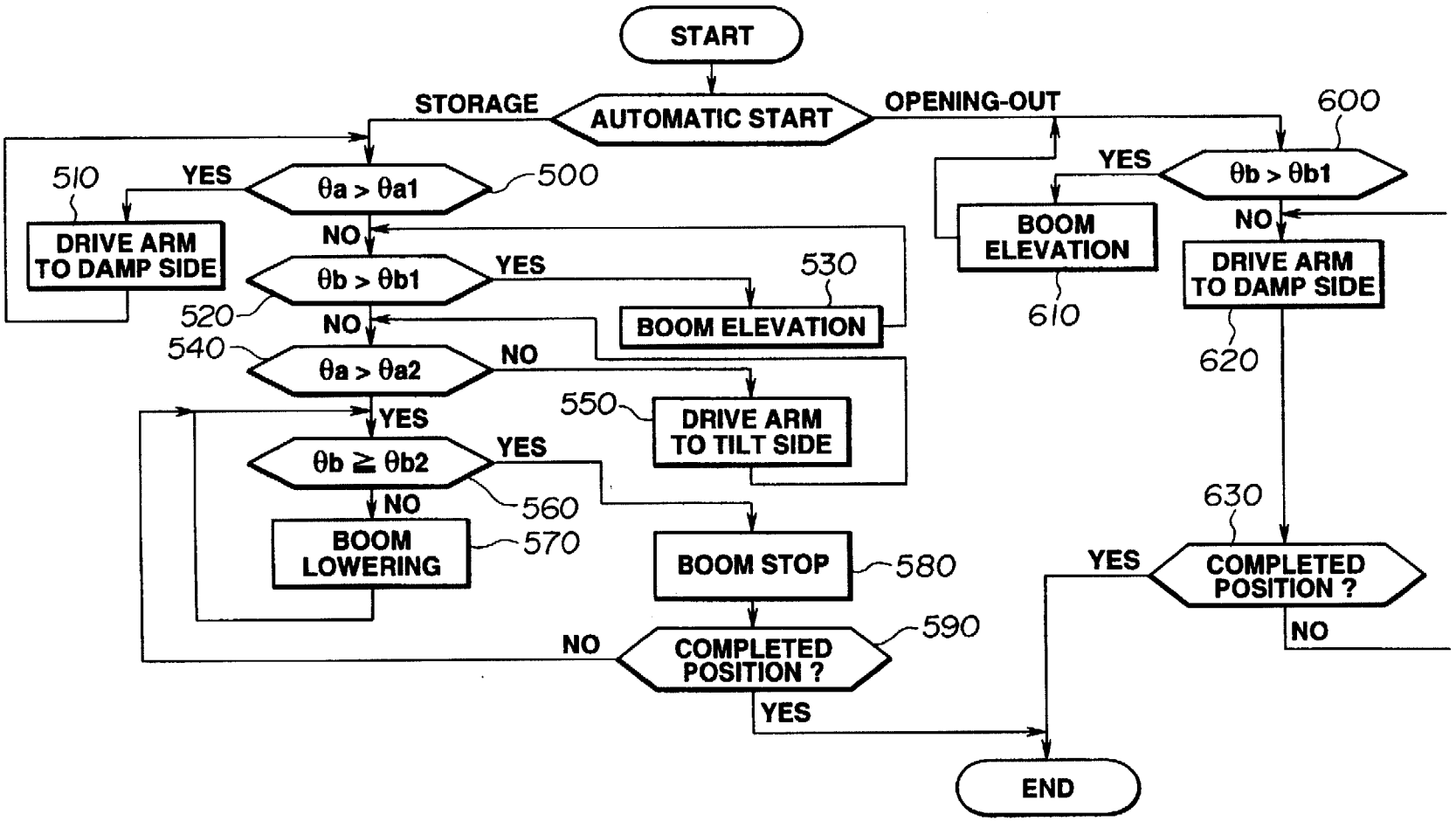
FIG. 22 is a flow chart showing the opening-out and storage action of a normal power shovel.

An explanation is given below of the storing and opening-out process for the power shovel in FIG. 21, following the flow chart in FIG. 22.

When storing, firstly arm angle $\theta a$ is compared with set angle $\theta a1$ (Step 500), and, when $\theta a>\theta a1$, the arm is driven to the dump side until $\theta a \leqq \theta a1$ (Step 510). Next, boom angle $\theta b$ is compared with set angle $\theta b1$, and the boom is raised until $\theta b$ is $\theta b1$ (Steps 520, 530). Next, the arm is driven to the tilt side until arm angle $\theta a$ is the tilt side stroke end angle $\theta a2$ (Steps 540, 550). Finally, boom angle $\theta b$ is compared with set angle $\theta b2$, and the boom is lowered until $\theta b$ is $\theta 62$, and a stored position is assumed where the bucket makes contact with the chassis (Steps 560 to 590).

When opening out, the boom angle $\theta b$ is first compared with the set angel $\theta b1$ and the boom is raised until $\theta b$ is $\theta b1$, and then the arm is driven to the dump side as far as a predetermined end position, so that the opening-out position is formed (Step 600 to 630).

It should be noted that in the abovementioned sequence each working machine was formed into the stored and opened-out positions by operating in an arc, but the stored and opened-out positions may be formed by straight line movement similarly to the two-piece boom type.

INDUSTRIAL APPLICABILITY

In the invention, a two-piece boom comprising a first boom rotatably mounted on a vehicle frame and a second boom rotatably mounted on the first boom can be used in two-piece boom type of construction machinery driven by a completely new cylinder link mechanism comprising a first boom cylinder connecting the vehicle frame and the second boom, and a second boom cylinder connecting the second boom and the first boom.

We claim:

1. A working machine control device for construction machinery, the construction machinery having a first boom rotatably mounted on a vehicle frame, a second boom rotatably mounted on the first boom, a first boom cylinder connecting the vehicle frame and the second boom, and a second boom cylinder connecting the second boom and the first boom, characterized in that the working machine control device comprises:

coordinate conversion means which subjects a working machine leading end target value to coordinate conversion to target angles for the first and second booms; and drive control means which determines a target cylinder length for the first boom cylinder from the target angles for the first and second booms obtained by the coordinate conversion, and drives the first boom cylinder according to the target cylinder length.

2. A working machine control device for construction machinery, the construction machinery having a first boom rotatably mounted on a vehicle frame, a second boom rotatably mounted on the first boom, a first boom cylinder connecting the vehicle frame and the second boom, and a second boom cylinder connecting the second boom and the first boom, characterized in that the working machine control device comprises:

conversion means which subjects a working machine leading end target value to conversion to a target angular velocity for the first and second booms; and drive control means which determines a target cylinder velocity for the first boom cylinder from the target angular velocity for the first and second booms obtained by the conversion, and drives the first boom cylinder according to the target cylinder velocity.

3. A working machine control device for working machinery, the working machinery being equipped with a bucket, arm and boom constituting working machines, characterized in that the working machine control device comprises:

operating instruction means which gives instructions for operating actions of storing and opening-out the working machinery; and opening-out and storage control means which automatically stores or opens-out the working machines following a predetermined track set in advance by instructions from the operating instruction means.

4. A working machine control device for working machinery as claimed in claim 3, wherein the working machinery has, as booms, a first boom rotatably mounted on a vehicle frame and a second boom rotatably mounted on the first boom, and wherein the opening-out and storage control means is equipped with storage control means having first means which executes a first routine in which a leading end of the second boom is positioned on any desired point on a predetermined straight-line track;

second means which, after the completion of the first routine, executes a second routine in which the bucket is tilted to a tilt end;

third means which, after the completion of the second routine, executes a third routine in which the arm is driven to a stroke end on an elevation side; and fourth means which, after the completion of the third routine, executes a fourth routine in which the leading end of the second boom is moved to the vehicle frame side following the predetermined straight-line track.

* * * * *